US005876584A

United States Patent [19]

Cortellini

[11] Patent Number: 5,876,584

[45] Date of Patent: Mar. 2, 1999

[54] METHOD OF PRODUCING ALUMINUM

[75] Inventor: Edmund A. Cortellini, North Brookfield, Mass.

[73] Assignee: Saint-Gobain Industrial Ceramics, Inc., Worcester, Mass.

[21] Appl. No.: 930,082

[22] PCT Filed: May 23, 1996

[86] PCT No.: PCT/US96/07514

§ 371 Date: Nov. 10, 1997

§ 102(e) Date: Nov. 10, 1997

[87] PCT Pub. No.: WO96/37637

PCT Pub. Date: Nov. 28, 1996

Related U.S. Application Data

[63] Continuation of Ser. No. 451,872, May 26, 1995, Pat. No. 5,560,809.

[51] Int. Cl.[6] ..... C25C 3/06

[52] U.S. Cl. ..... 205/379; 205/396

[58] Field of Search ..... 204/243 R–247; 205/394, 396, 372, 379

[56] References Cited

U.S. PATENT DOCUMENTS

| | | | |
|---|---|---|---|
| 2,915,442 | 12/1959 | Lewis | 204/67 |
| 3,256,173 | 6/1966 | Schmitt et al. | 204/243 |
| 3,514,520 | 5/1970 | Bacchiega et al. | 13/35 |
| 3,666,654 | 5/1972 | De Garab | 204/243 R |
| 4,187,344 | 2/1980 | Fredriksson | 428/304 |
| 4,224,128 | 9/1980 | Walton | 204/243 R |
| 4,411,758 | 10/1983 | Hess et al. | 204/243 X |
| 4,529,494 | 7/1985 | Joo et al. | 204/290 R |
| 4,544,641 | 10/1985 | Dumas et al. | 501/87 |
| 4,560,448 | 12/1985 | Sane et al. | 204/67 |
| 4,592,820 | 6/1986 | McGeer | 204/243 R |
| 4,737,253 | 4/1988 | Gesing et al. | 204/243 R |
| 5,006,209 | 4/1991 | Beck et al. | 205/394 X |
| 5,028,301 | 7/1991 | Townsend | 204/39 |
| 5,158,655 | 10/1992 | Townsend | 204/67 |
| 5,227,045 | 7/1993 | Townsend | 205/230 |
| 5,279,715 | 1/1994 | LaCamera et al. | 204/243 R |
| 5,286,353 | 2/1994 | Wilkening | 204/67 |
| 5,286,359 | 2/1994 | Richards | 204/243 R |
| 5,310,476 | 5/1994 | Sekhar et al. | 205/230 |
| 5,314,599 | 5/1994 | Allaire | 204/243 R |
| 5,322,826 | 6/1994 | Becker et al. | 501/127 |
| 5,340,448 | 8/1994 | Sekhar et al. | 204/67 |
| 5,342,491 | 8/1994 | Sekhar | 204/243 R |
| 5,378,327 | 1/1995 | Sekhar et al. | 204/67 |
| 5,560,809 | 10/1996 | Cortellini | 204/243 R |

FOREIGN PATENT DOCUMENTS

| | | | |
|---|---|---|---|
| 0094353 | 11/1983 | European Pat. Off. | C25C 3/08 |
| 1650784 | 9/1988 | U.S.S.R. | C25C 3/12 |
| 90/01078 | 2/1990 | WIPO | C25C 3/08 |
| 93/25731 | 12/1993 | WIPO | C25C 3/06 |
| 94/24337 | 10/1994 | WIPO | C25C 3/00 |

*Primary Examiner*—Donald R. Valentine
*Attorney, Agent, or Firm*—Thomas M. DiMauro

[57] ABSTRACT

A method of producing aluminum, comprising the steps of:

a) providing an aluminum reduction Hall cell for reduction of alumina in molten fluoride electrolyte containing cryolite, the cell comprising a cathode, an anode and a sidewall, the sidewall having a thickness and comprising:

i) a lining consisting essentially of a material selected from the group consisting of silicon nitride, silicon carbide, and boron carbide, and having a density of at least 95% of theoretical density, and no apparent porosity, and ii) an insulating layer backing the lining, b) contacting the lining with an electrolyte comprising at least 60% cryolite and having a temperature of between 650° C. and 1100° C., and c) providing an electric current from the cathode to the anode through the electrolyte, thereby producing aluminum at the cathode, wherein the electrolyte temperature, the cryolite concentration and the thickness of the sidewall are predetermined so that the cryolite does not form a frozen crust anywhere on the lining.

25 Claims, 1 Drawing Sheet

METHOD OF PRODUCING ALUMINUM

This application is a Section 371 national phase conversion of PCT patent application PCT/US96/07514, filed May 23, 1996, and a continuation of U.S. Ser. No. 08/451,872, filed May 26, 1995, now U.S. Pat. No. 5,560,809.

BACKGROUND OF THE INVENTION

Conventional virgin aluminum production typically involves the reduction of alumina which has been dissolved in a cryolite-containing electrolyte. The reduction is carried out in a Hall-Heroult cell ("Hall cell") containing a carbon anode and a carbon cathode which also serves as a container for the electrolyte. When current is run through the electrolyte, liquid aluminum is deposited at the cathode while gaseous oxygen is produced at the anode.

The sidewalls of the Hall cell are typically made of a porous, heat conductive material based on carbon or silicon carbide. However, since it is well known in the art that the cryolite-containing electrolyte aggressively attacks these sidewalls, the sidewalls are designed to be only about 3–6 inches thick so as to provide enough heat loss out of the Hall cell to allow the formation of a frozen layer of cryolite on the surface of the sidewall, thereby preventing further cryolite infiltration and degradation of the sidewall.

Although the frozen cryolite layer successfully protects the sidewalls from cryolite penetration, it does so at the cost of significant heat loss. Accordingly, modern efficiency concerns have driven newer Hall cell designs to contain more heat insulation in the sidewalls. However, since these designs having significant thermal insulation also prevent significant heat loss, cryolite will not freeze against its sidewalls. Therefore, the initial concerns about cryolite penetration and sidewall degradation have reappeared.

U.S. Pat. No. 4,592,820 ("the '820 patent") attempts to provide both thermal efficiency and sidewall protection from cryolite penetration. The '820 patent teaches replacing the porous, heat conductive sidewall with a two-layer sidewall comprising:

a) a first layer made of a conventional insulating material provided in sufficient thickness to assure that cryolite will not freeze on the sidewall, and b) a lining made of a ceramic material resistant to attack by the cell electrolyte (cryolite) and molten aluminum.

See column 2, lines 30–43 of the '820 patent. The '820 patent further discloses that preferred linings are made of Group IVb, Vb or VIb refractory metal carbides, borides or nitrides, oxynitrides and especially titanium diboride and teaches these selected ceramic materials can be used as either fabricated tiles or as coatings on sidewalls such as alumina or silicon carbide. See column 2, lines 44–47 and column 4, lines 24–32.

Although the '820 patent provides a cryolite-resistant aluminum reduction cell having improved heat efficiency, it nonetheless can be improved upon. For example, the disclosed linings suffer from high cost and limited availability.

Moreover, the preferred lining of the '820 patent, titanium diboride, is not only very expensive, it also possesses marginal oxidation resistance and is electrically conductive in operation.

In addition, the preferred Hall cell of the '820 patent produces a solid cryolite layer in the electrolyte zone adjacent the top edge of the sidewall to protect the ceramic material against aerial oxidation. This top layer may be developed by either capping the sidewall with carbon and reducing its backing insulation, or by positioning a steel pipe carrying cool air adjacent the top edge of the sidewall. Although these measures improve cryolite resistance, they also reduce the heat efficiency of the cell.

U.S. Pat. No. 4,865,701 ("Beck") discloses an aluminum production cell having cooling tubes provided within the insulating layer of its sidewall.

U.S. Pat. No. 2,971,899 ("Hannick") discloses a cell for electroplating aluminum from a solution containing about 20% cryolite. U.S. Pat. No. 2,915,442 ("Lewis") discloses an aluminum production cell wherein a frozen crust appears on the sidewall. U.S. Pat. No. 3,256,173 ("Schmitt") discloses an aluminum production cell having a lining of silicon carbide, coke and pitch. U.S. Pat. No. 3,428,545 ("Johnson") discloses an aluminum production cell having a carbon lining backed by refractory particles including silicon nitride.

Accordingly, there is a need for an improved Hall Cell.

SUMMARY OF THE INVENTION

In accordance with the present invention, there is provided method of producing aluminum, comprising the steps of:

a) providing an aluminum reduction cell comprising a cathode, an anode and a sidewall, the sidewall having a thickness and comprising:

i) a lining consisting essentially of a material selected from the group consisting of silicon nitride, silicon carbide, and boron carbide, and having a density of at least 95% of theoretical density, at least closed porosity, and no apparent porosity, and ii) an insulating layer backing the lining, b) contacting the lining with an electrolyte comprising at least 60% cryolite and having a temperature of between 650° C. and 1100° C., and c) providing an electric current from the cathode to the anode through the electrolyte, thereby producing aluminum at the cathode, wherein the electrolyte temperature, the cryolite concentration and the thickness of the sidewall are predetermined so that the cryolite does not form a frozen crust anywhere on the lining.

In preferred embodiments, the sidewall has no cooling tubes embedded therein and so consists essentially of the lining and the insulating layer.

Also in accordance with the present invention, there is provided a sidewall lining for use in an electrolytic reduction Hall cell for the production of aluminum by reduction of alumina in a molten fluoride electrolyte containing cryolite, the cell comprising a sidewall, the sidewall having a top edge and comprising an insulating material and the lining wherein:

a) the insulating material is provided in sufficient thickness to assure that cryolite will not freeze anywhere but the top edge of the sidewall, and b) the lining consists essentially of a ceramic material having a density of at least 95% of theoretical density and at least closed porosity, the ceramic material selected from the group consisting of silicon carbide, silicon nitride and boron carbide, wherein the top edge of the sidewall has a frozen electrolyte crust thereon.

Also in accordance with the present invention, there is provided an electrolytic reduction Hall cell for the production of aluminum by reduction of alumina in a molten fluoride electrolyte maintained at a temperature of about 960° C. and containing cryolite, the cell comprising:

i) means for maintaining the molten fluoride electrolyte at a temperature of about 960° C., and ii) a sidewall comprising an insulating material and a lining, wherein:

a) the insulating material is provided in sufficient thickness to assure that cryolite will not freeze anywhere on the lining, and b) the lining is made of a ceramic material resistant to attack by cryolite and molten aluminum.

Also in accordance with the present invention, there is provided an electrolytic reduction Hall cell for the production of aluminum by reduction of alumina in a molten fluoride electrolyte containing cryolite, the cell comprising a sidewall comprising an insulating material and a lining, wherein:

a) the insulating material is provided in sufficient thickness to assure that cryolite will not freeze anywhere on the lining, and b) the lining is made of a ceramic material resistant to attack by cryolite and molten aluminum, wherein the lining consists essentially of silicon nitride having a density of at least 95% of theoretical density, at least closed porosity and no apparent porosity.

Also in accordance with the present invention, there is provided an electrolytic reduction Hall cell for the production of aluminum by reduction of alumina in a molten fluoride electrolyte containing cryolite, the cell comprising a sidewall comprising an insulating material and a lining, wherein:

a) the insulating material is provided in sufficient thickness to assure that cryolite will not freeze anywhere on the lining, and b) the lining is made of a ceramic material resistant to attack by cryolite and molten aluminum, wherein the lining consists essentially of boron carbide having a density of at least 95% of theoretical density, at least closed porosity and no apparent porosity.

DETAILED DESCRIPTION OF THE INVENTION

Figure 1:
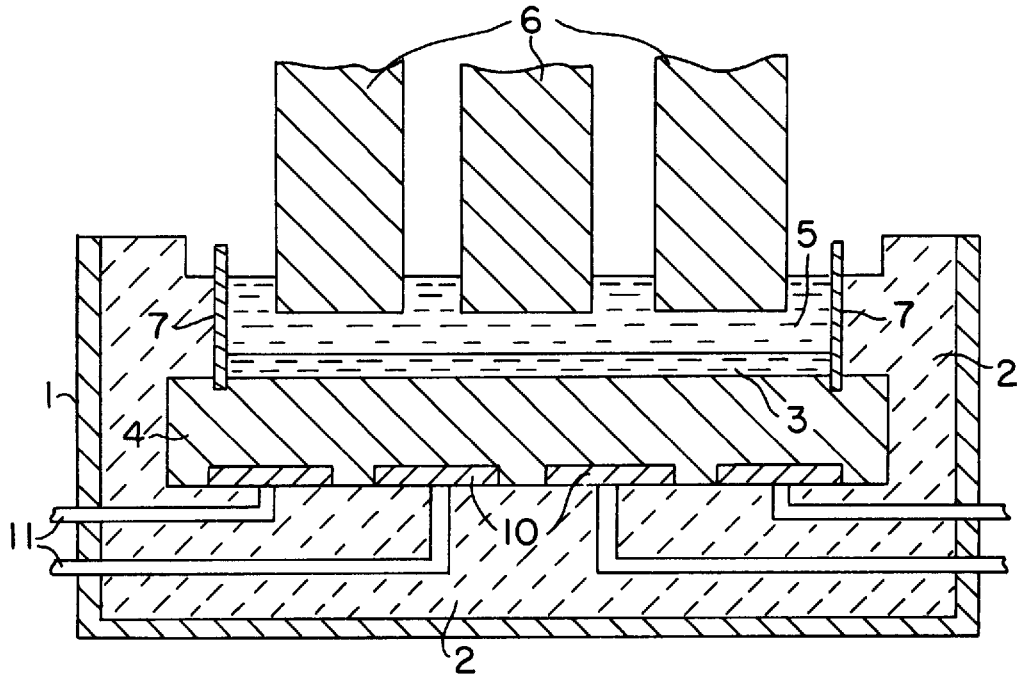
FIG. 1 is a drawing of a preferred embodiment of the present invention.

Use of silicon carbide as the sidewall lining offers an advantage over the materials disclosed in the '820 patent in that it has better thermal shock resistance than and is less expensive than titanium diboride, and is more stable than oxynitrides when in contact with cryolite. Interestingly, the '820 patent twice discourages using silicon carbide as the sidewall lining. First, it asserts the unsuitable performance of the SiC-containing lining disclosed in U.S. Pat. No. 3,256,173. See column 3, lines 40–43 of the '820 patent. Second, it advocates placing a boride, nitride or oxynitride coating thereon when SiC is used as the sidewall. See column 2, line 47 of the '820 patent.

If silicon carbide is selected as the sidewall lining, it should be at least 95% dense and should have an apparent porosity of near zero. If needed, conventional sintering aids such as boron, carbon and aluminum may be present in the silicon carbide ceramic material. Accordingly, any hot pressed, hot isostatically pressed or pressureless sintered silicon carbide ceramic having either at least closed porosity and preferably no apparent porosity is contemplated as within the scope of the invention.

Use of boron carbide as the sidewall lining offers an advantage over the materials disclosed in the '820 patent in that it is an electrical insulator, has a lower thermal conductivity than, and is less expensive than titanium diboride.

If boron carbide is selected as the sidewall lining, it should be at least 95% dense and should have an apparent porosity of near zero. If needed, conventional sintering aids such as boron, carbon and aluminum may be present in the boron carbide ceramic material. Accordingly, any hot pressed, hot isostatically pressed or pressureless sintered boron carbide ceramic having at least closed porosity and preferably no apparent porosity is contemplated as within the scope of the invention.

Use of silicon nitride as the sidewall lining offers an advantage over the materials disclosed in the '820 patent in that it is an electrical insulator, has a lower thermal conductivity than, and is less expensive than titanium diboride.

If silicon nitride is selected as the sidewall lining, it should be at least 95% dense and should have an apparent porosity of near zero. If needed, conventional sintering aids such as magnesia, yttria, and alumina be present in the silicon nitride ceramic material. Accordingly, any hot pressed, hot isostatically pressed or pressureless sintered silicon nitride ceramic having at least closed porosity and preferably no apparent porosity is contemplated as within the scope of the invention.

The teachings of the '820 patent respecting damping movement of the molten metal pool(column 4, lines 57–66); fixing the ceramic material on the sidewall (column 4, lines 20–44); using a current collection system which ensures that the current passes substantially vertically through the carbon bed (column 2, line 58 to column 3, line 25); and, using panels at least 0.25 cm or 0.5 cm thick as the lining (column 4, line 67 to column 5, line 3) may also be suitably used in accordance with the present invention and are hereby incorporated by reference herein.

Although not particularly preferred, the teaching of the '820 patent advocating a frozen cryolite layer at the top of the sidewall may also be practiced in accordance with the present invention. However, preferred embodiments of the present invention are designed with a consistent vertical heat loss profile so that no upper frozen cryolite layer is formed.

Referring now to FIG. 1, there is provided a sectional side view of an electrolytic reduction cell of the present invention. Within a steel shell 1 is a thermally and electrically insulating sidewall 2 of alumina blocks. The cathode of the cell is constituted by a pad 3 of molten aluminum supported on a bed 4 of carbon blocks. Overlying the molten metal pad 3 is a layer 5 of molten electrolyte in which anodes 6 are suspended. Ceramic tiles 7 constitute the sidewall lining. These are fixed at their lower edges in slots machined in the carbon blocks 4, their upper edges being free. Because no cooling means is introduced at the top of the sidewalls, no solid crust has been formed at the top edge of the electrolyte layer.

A current collector bar 10 is shown in four sections between the carbon bed 4 and the alumina sidewall 2. Each section is connected at a point intermediate its ends to a connector bar 11 which extends through the shell 1. The electrical power supply between the anodes 6 and the connector bars 11 outside the shell 1 is not shown.

In use, electrolyte 5 is typically maintained at a temperature of between about 800° C. and about 1100° C., more typically between about 900° C. and 1010° C., with many applications at about 960° C. However, in some instances the temperature is maintained at between about 650° C. and 800° C. The electrolyte typically contains at least about 60 weight percent ("w/o") cryolite, more preferably at least about 85 w/o cryolite, more preferably at least about 90 w/o cryolite. The electrolyte typically further comprises between about 2 w/o and 10 w/o alumina, (typically about 6 w/o), and between about 4 w/o and 20 w/o aluminum fluoride (more typically about 8 w/o). The thermal insulation of the sidewall is provided in such a thickness that a layer of frozen electrolyte does not form anywhere on the sidewall. The current collection system 10 and 11 ensures that the current passes substantially vertically through the carbon bed 4.

I claim:

1. A method of producing aluminum, comprising the steps of:

a) providing an aluminum reduction Hall cell for reduction of alumina in molten fluoride electrolyte containing cryolite, the cell comprising a cathode, an anode and a sidewall, the sidewall having a thickness and comprising:

i) a lining consisting essentially of a material selected from the group consisting of silicon nitride, silicon carbide, and boron carbide, and having a density of at least 95% of theoretical density, and no apparent porosity, and ii) an insulating layer backing the lining, b) contacting the lining with an electrolyte comprising at least 60% cryolite and having a temperature of between 650° C. and 1100° C., and c) providing an electric current from the cathode to the anode through the electrolyte, thereby producing aluminum at the cathode, wherein the electrolyte temperature, the cryolite concentration and the thickness of the sidewall are predetermined so that the cryolite does not form a frozen crust anywhere on the lining.

2. The method of claim 1 wherein the sidewall consists essentially of the lining and the insulating layer.

3. The method of claim 1 wherein the electrolyte has a temperature of between about 800° C. and about 1100° C.

4. The method of claim 1 wherein the electrolyte has a temperature of between about 900° C. and 1010° C.

5. The method of claim 1 wherein the electrolyte has a temperature of about 960° C.

6. The method of claim 1 wherein the electrolyte has a temperature of between about 650° C. and 800° C.

7. The method of claim 6 wherein the lining consists essentially of silicon carbide.

8. The method of claim 7 wherein the lining is in the form of a tile or panel having a thickness of at least 0.5 cm.

9. The method of claim 6 wherein the lining consists essentially of silicon nitride.

10. The method of claim 9 wherein the lining is in the form of a tile or panel having a thickness of at least 0.5 cm.

11. The method of claim 6 wherein the lining consists essentially of boron carbide.

12. The method of claim 11 wherein the lining is in the form of a tile or panel having a thickness of at least 0.5 cm.

13. The method of claim 1 wherein the electrolyte comprises at least about 85 w/o cryolite.

14. The method of claim 1 wherein the electrolyte comprises at least about 90 w/o cryolite.

15. The method of claim 1 wherein the electrolyte further comprises between about 2 w/o and 10 w/o alumina.

16. The method of claim 1 wherein the electrolyte further comprises about 6 w/o alumina.

17. The method of claim 1 wherein the electrolyte further comprises between about 4 w/o and 20 w/o aluminum fluoride.

18. The method of claim 1 wherein the electrolyte further comprises about 8 w/o aluminum fluoride.

19. The method of claim 1 wherein the lining consists essentially of silicon carbide.

20. The method of claim 19 wherein the lining is in the form of a tile or panel having a thickness of at least 0.5 cm.

21. The method of claim 1 wherein the lining consists essentially of silicon nitride.

22. The method of claim 21 wherein the lining is in the form of a tile or panel having a thickness of at least 0.5 cm.

23. The method of claim 1 wherein the lining consists essentially of boron carbide.

24. The method of claim 23 wherein the sidewall is in the form of a tile or panel having a thickness of at least 0.5 cm.

25. The method of claim 1 wherein the sidewall consists essentially of the lining and the insulating layer, and no upper frozen electrolyte layer adjacent the top edge of the lining is formed.

* * * * *